United States Patent [19]

Kawamata et al.

[11] 4,445,996

[45] May 1, 1984

[54] ANODE PASTE FOR USE IN SODERBERG-TYPE ELECTROLYTIC FURNACE FOR ALUMINUM

[75] Inventors: Yutaka Kawamata, Tokyo; Shunkichi Katsuki, Kitakyushu, both of Japan

[73] Assignee: Mitsubishi Light Metal Industries Limited, Tokyo, Japan

[21] Appl. No.: 390,988

[22] Filed: Jun. 22, 1982

[30] Foreign Application Priority Data

Jul. 9, 1981 [JP] Japan ..... 56-107391

[51] Int. Cl.[3] ..... C25C 7/02

[52] U.S. Cl. ..... 204/294

[58] Field of Search ..... 204/294

[56] References Cited

U.S. PATENT DOCUMENTS 2,835,605 5/1958 Nelson et al. ..... 204/294 X
3,065,094 11/1962 Sandberg ..... 204/294 X
3,102,041 8/1963 Sandberg ..... 204/294 X
3,284,334 11/1966 Metrailer et al. ..... 204/294

OTHER PUBLICATIONS

Kodaj et al., Chemical Abstracts, vol. 68, abstract 106,718j (1968).

Mason, Chemical Abstracts, vol. 73, abstract 20838q (1970).

*Primary Examiner*—F. Edmundson

*Attorney, Agent, or Firm*—Oblon, Fisher, Spivak, McClelland & Maier

[57] ABSTRACT

An anode paste for use in Söderberg-type electrolytic furnace for aluminum is disclosed, the paste comprising an aggregate and a binder, wherein the aggregate contains 20 to 35% by weight of a coke of a diameter of smaller than 0.08 mm and the weight ratio of the particles thereof of size of 0.2 to 2 mm to those of size of smaller than 0.08 mm is 0.5 to 1.3.

5 Claims, 2 Drawing Figures

ANODE PASTE FOR USE IN SODERBERG-TYPE ELECTROLYTIC FURNACE FOR ALUMINUM

BACKGROUND OF THE INVENTION (1) Field of the Invention

The present invention relates to an anode paste for use in the electrolytic furnace for aluminum, and particularly, relates to an anode paste for use in Söderberg-type electrolytic furnace for aluminum.

(2) Description of the Prior Art

The anode paste for use in the anode of Söderberg-type electrolytic furnace for aluminum is usually prepared by pulverizing cokes such as calcined pitch cokes or petroleum cokes to obtain pulverized cokes as an aggregate, adding a suitable amount of a binder such as tar pitch to the aggregate, kneading the thus formed mixture to be a paste-like state, and solidifying the paste-like mixture into a briquette-like shape. The thus prepared anode paste is put into the electrolytic furnace from the upper part of the anode in an amount corresponding to the amount of consumption thereof at the lower surface of the anode and then the anode paste constitutes the baked carbon anode while gradually moving downwards with the consumption of the anode by the electrolysis.

As the important items in the performance of carbon anode formed by baking the paste during the electrolysis shown above, the following three points are mentioned.

(1) The carbon anode should have high electrical conductivity.

(2) The amount of consumption of carbon by electrolysis should be small.

(a) On the following two reactions, the amount of consumption of carbon due to the secondary reaction should be small (in other words, the secondary reaction difficultly occurs).

$$Al_2O_3+3/2C \rightarrow 2Al+3/2CO_2 \text{ (primary reaction)}$$

$$C+CO_2 \rightarrow 2CO \text{ (secondary reaction)}$$

(b) The amount of anode carbon which disintegrates as a floating carbon on the surface of electrolytic bath should be small.

(3) The contact between the spike and the anode should be favorable (there are occasions where anode carbon cracks due to the thermal expansion of the spike and to the contraction of the anode paste during the baking step to make the contact between the spike and the carbon poor.).

Usually, the above-mentioned performances of the anode depends on the composition of the aggregate, the composition of the binder, the amount of them and the like. However, the relationship between the performance of the anode and such a factor has not been satisfactorily clarified.

The present inventors have made studies on the anode paste which is able to maintain the above-mentioned performances as the anode in suitable state, and as a result, have found that the anode of extremely favorable performances can be formed by maintaining the particle size-distribution of the aggregate in a specified range, and have attained the present invention.

SUMMARY OF THE INVENTION

It is an object of the present invention to provide an anode paste for use in the electrolytic furnace for aluminum. Another object of the present invention is to provide an anode paste for use in Söderberg-type electrolytic furnace for aluminum.

Still another object of the present invention is to provide an anode paste which is able to form an anode for the electrolytic furnace for aluminum, in which the anode has high electrical conductivity, shows a small consumption of carbon thereof in electrolysis, and is small in thermal contraction or shrinkage during baking.

An anode paste for use in Söderberg-type electrolytic furnace for aluminum, comprising an aggregate and a binder, wherein the aggregate contains 20 to 35% by weight of coke particles of a size of smaller than 0.08 mm and the weight ratio of the coke particles of a size of 0.2 to 2.0 mm to the coke particles of a size of smaller than 0.08 mm is 0.5 to 1.3 in the aggregate, is provided by the present invention.

DETAILED DESCRIPTION OF THE INVENTION

The present invention will be explained in detail as follows.

As the aggregate used in the anode paste according to the present invention, pitch coke, oil coke and the like can be mentioned.

The relative contents of the particles of different sizes in the aggregate of the present invention are as follows: (1) the content of the particles of a size of smaller than 0.08 mm is 20 to 35% by weight of the aggregate and (2) the weight ratio of the particles of a size of 0.2 to 2 mm to the particles of a size of less than 0.08 mm is 0.5 to 1.3.

As has been shown above, the aggregate is mixed and kneaded with a binder such as a tar pitch to be a paste. There is an optimum value in the amount of the binder to be compounded with the aggregate, and it is preferable to use at least an amount of the binder sufficient to wet the surfaces of all the particles of the aggregate. The amount of the binder used in the present invention is preferably, 20 to 32% by weight of the sum of the weights of the aggregate and the binder, and it is more preferable to be 22 to 26% by weight.

Figure 1:
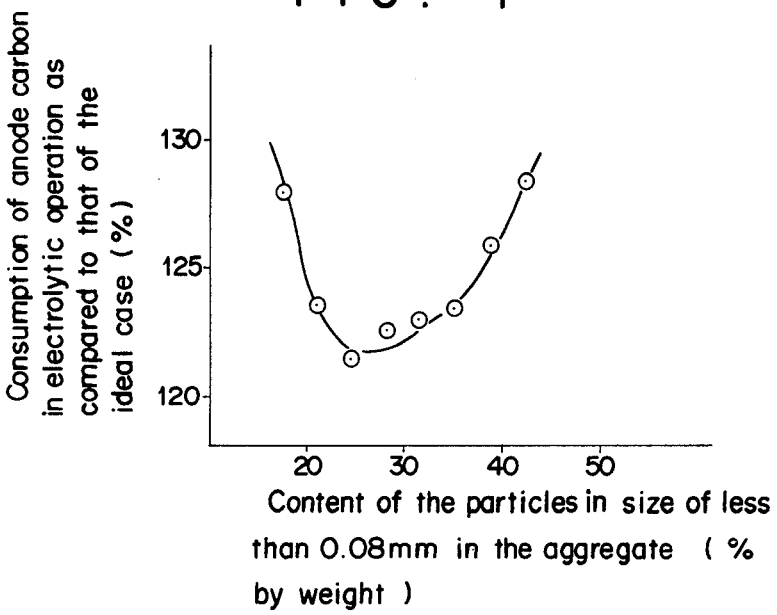
FIG. 1 is a graph showing a relationship between the content of the particles of a size of smaller than 0.08 mm in the aggregate and the amount of consumption of anode carbon in electrolysis.

In the present invention, by controlling the content of the particles of a size of smaller than 0.08 mm in the aggregate to be 20 to 35% by weight, the amount of consumption of anode carbon during electrolysis is effectively maintained at a low level, and this is clearly seen in FIG. 1 which shows the relationship between the content of the particles of a size of smaller than 0.08 mm in the aggregate and the consumed amount of anode carbon in electrolysis.

In FIG. 1, the content of the particles of a size of smaller than 0.08 mm in the aggregate was taken in the abscissa (as percentage by weight) and the consumption of anode carbon in the actual operation of electrolysis as compared to the theoretical consumption of anode carbon as 100 percent while taking the current efficiency and the evaporation of carbon into account was taken in the ordinate, and as is seen in FIG. 1, the consumed amount of anode carbon by electrolysis for aluminum is maintained at a low level in the case where the content of the particles of a size of smaller than 0.08 mm is 20 to 35% by weight of the aggregate, preferably 23 to 27% by weight, and particularly suitable at around 25% by weight.

The content of the particles of a size of less than 0.08 mm in the aggregate gives a large effect on the rate of contraction during the formation of anode carbon from the carbon paste by baking and dominates the contact between the spike and the thus formed anode.

Figure 2:
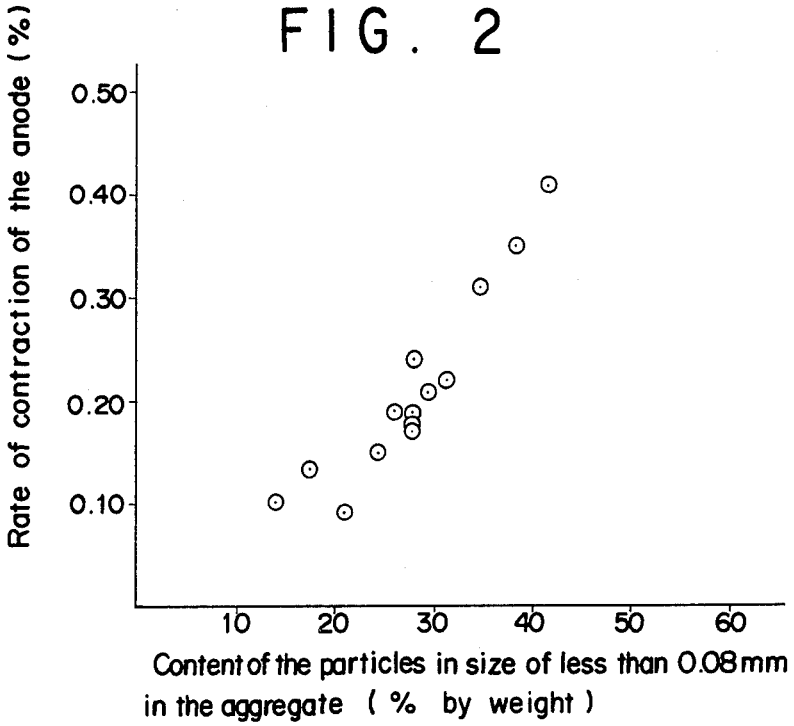
FIG. 2 is a graph showing a relationship between the content of the particles of a size of smaller than 0.08 mm in the aggregate and the rate of contraction of the anode during the baking in electrolysis.

It is considered that the rate of contraction of the anode of less than 0.3% gives a favorable contact. According to FIG. 2 wherein the rate of contraction of anode is taken in the ordinate and the content (% by weight) of the particles of a size of less than 0.08 mm in the aggregate was taken in the abscissa, the rate of contraction of anode carbon during the baking is nearly 0.1 to 0.25% in the case where the content of the particles of a size of smaller than 0.08 mm is 20 to 35% by weight of the aggregate. Accordingly, it is clearly understood that the content of the particles of a size of smaller than 0.08 mm in the aggregate according to the present invention can maintain the rate of contraction of anode carbon during the baking in a favorable range.

Figure 3:
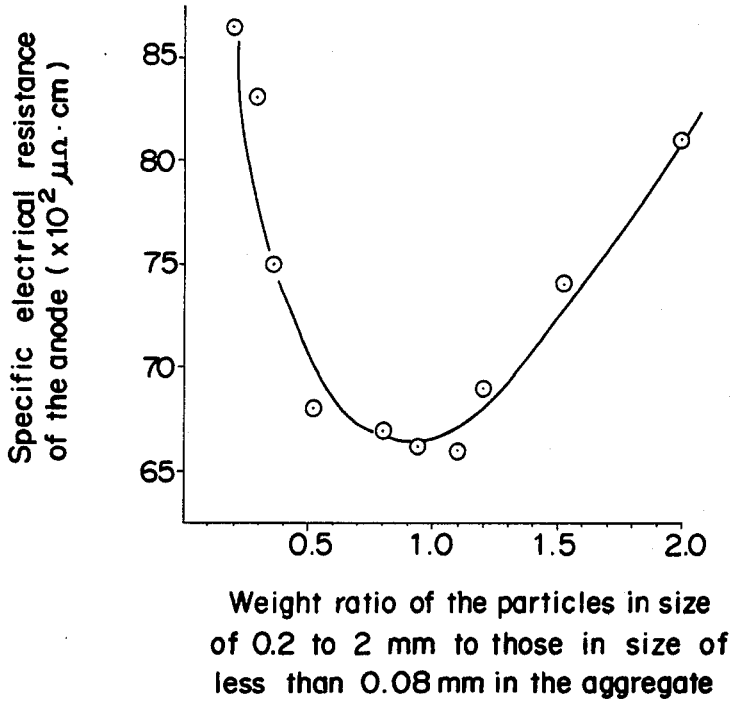
FIG. 3 is a graph showing a relationship between the weight ratio of the particles of a size of 0.2 to 2 mm to the particle of a size smaller than 0.08 mm in the aggregate and the specific electrical resistance of the anode.

The weight ratio of the particles of a size of 0.2 to 2 mm to the particles of a size of smaller than 0.08 mm in the aggregate has an influence on the electrical conductivity of the anode prepared thereof. FIG. 3 shows the relationship between the electrical conductivity of the anode and the above-mentioned weight ratio, in which the content of the particles of a size of smaller than 0.08 mm is maintained at 20 to 35% by weight of the aggregate, while taking the weight ratio in the abscissa and taking the specific electrical resistance of the anode in the ordinate. As is clearly seen in the graph of FIG. 3, in the case where the weight ratio is 0.5 to 1.3, particularly 0.7 to 1.0, the specific electrical resistance of the anode is small enough to maintain the electrical conductivity of the anode in a favorable range.

In the present invention, the rest of the aggregate other than those of a size of smaller than 0.08 mm and those of a size in the range of 0.2 to 2 mm is preferably of a size of less than 12 mm.

In the case where the anode paste according to the present invention is used, it is possible to form the anode for use in the electrolytic furnace for aluminum, which has high electrical conductivity, and can maintain a favorable contact to the spike with a small consumption of carbon thereof in electrolysis.

The present invention will be explained more in detail while referring to the following non-limitative examples showing the concrete mode.

EXAMPLE AND COMPARATIVE EXAMPLE

Operation of a Söderberg-type electrolytic furnace for aluminum was carried out while using the following two series of anode pastes, i.e., the one for Example and the other for Comparative example. The composition of the anode pastes, i.e., the composition of the aggregate (pitch coke) and the amount of the binder (pitch) was shown in Table with the the results of the operation of electrolysis.

TABLE

| | Classification | Example | Comparative Example |
|---|---|---|---|
| Composition of Paste | Aggregate (part by weight) | 100 | 100 |
| | those in size smaller than 0.08 mm | 20 | 42 |
| | those in size in the range of 0.2 to 2 mm | 18 | 15 |
| | the remainder of a size larger than 0.08 mm and less than 0.2 mm and larger than 2 mm and less than 12 mm. | 62 | 43 |
| | Pitch (% by weight of the paste) | 23.5 | 27.5 |
| Operation Data | Voltage drop in Anode (mV) | 470 | 520 |
| | Power Consumption (KWH/ton-aluminum) | 13,300 | 13,500 |
| | Consumption of Anode carbon (kg/ton-aluminum) | 480 | 505 |

As are seen in Table, a remarkable effect of improvement has been attained by using the anode paste according to the present invention.

What is claimed is:

1. An anode paste for use in the fabrication of the self-baking anode of a Soderberg-type electrolytic furnace for the manufacture of aluminum, comprising:

a mixture of an aggregate selected from the group consisting of oil cake and pitch coke and a tar pitch binder, said aggregate being of a size less than 12 mm and containing 20 to 35 wt. % of coke particles of a size less than 0.08 mm, and the weight ratio of the coke particles of a size of 0.2 to 2 mm to the coke particles of a size less than 0.08 mm ranging 0.5 to 1.3, the amount of said binder ranging from 20 to 32% by weight of the total amount of said mixed aggregate and binder.

2. The anode paste of claim 1, wherein said aggregate is pitch coke.

3. The anode paste of claim 1 or 2, wherein said aggregate contains 23 to 27% by weight of the said coke particles of a size smaller than 0.08 mm.

4. The anode paste of claim 1 or 2, wherein the weight ratio of the coke particles of the size range of 0.2 to 2 mm to the coke particles of a size range smaller than 0.08 mm ranges from 0.7 to 1.0.

5. The anode paste of claim 1 or 2, wherein the amount of said binder ranges from 22 to 26% by weight.

* * * * *